US009545734B2

(12) United States Patent
Suhling

(10) Patent No.: US 9,545,734 B2
(45) Date of Patent: Jan. 17, 2017

(54) MICRO FENCE ADJUSTER ASSEMBLY

(71) Applicant: Robert James Suhling, Waukegan, IL (US)

(72) Inventor: Robert James Suhling, Waukegan, IL (US)

( * ) Notice: Subject to any disclaimer, the term of this patent is extended or adjusted under 35 U.S.C. 154(b) by 281 days.

(21) Appl. No.: 14/262,702

(22) Filed: Apr. 25, 2014

(65) Prior Publication Data

US 2015/0306784 A1 Oct. 29, 2015

(51) Int. Cl.

*B27B 27/10* (2006.01)
*B27B 27/02* (2006.01)
*B27B 27/08* (2006.01)

(52) U.S. Cl.

CPC ..... *B27B 27/10* (2013.01); *B27B 27/02* (2013.01); *B27B 27/08* (2013.01)

(58) Field of Classification Search

CPC ..... B27B 27/00; B27B 27/02
USPC ..... 83/467.1, 468, 468.7, 438, 441, 477.2; 144/287
See application file for complete search history.

(56) References Cited

U.S. PATENT DOCUMENTS 4,256,000 A * 3/1981 Seidel ..... B27B 27/02 83/468
5,768,966 A * 6/1998 Duginske ..... B27B 25/10 144/253.1
5,845,555 A * 12/1998 Dawley ..... B23Q 16/006 83/467.1
6,725,754 B2 * 4/2004 MacKenzie ..... B23Q 3/007 269/303

* cited by examiner

*Primary Examiner* — Sarah McPartlin

(57) ABSTRACT

A clamp that is meant to act as a coordinate locator for any number of power tools, but most specifically for use with the Biesemeyer T-style table saw fences. The assembly is comprised of a C-frame which offers the ability to enact a clamping action and the ability to enact an indexing action. The design of the assembly allows not only for the clamping of an imprecise reference point along a table saw fence rail, but also the fine adjustment of indexing a screw against the table saw fence.

5 Claims, 7 Drawing Sheets

Figure 3A, 3B, and 3C

MICRO FENCE ADJUSTER ASSEMBLY

RELATED U.S. APPLICATION DATA

I claim protection and the priority of this patent application as extensively as is permitted through the rights granted by provisional patent application No. 61/854,683; filed on Apr. 30, 2013

PROSPECTIVE US PATENT CLASSES AND SUBCLASSES

83/374
83/438
83/453
144/357

PUBLICATION CLASSIFICATION

Prior Art Citation(s)

| | | | |
|---|---|---|---|
| U.S. Pat. No. 4,206,910 A | William M. Biesemeyer | Jun. 28, 1978 | 269/236 |

Relevant Citation(s)

| | | | |
|---|---|---|---|
| U.S. Pat. No. 236,239 A | Edward L. Morris | May 21, 1880 | 269/181 |
| US 20080271583 A1 | Bor-Yann Chuang | May 4, 2007 | 83/438 |
| U.S. Pat. No. 8,584,564 B2 | Robert P. Welsh et al. | Nov. 19, 2013 | 83/477.2 |

TECHNICAL FIELD OF THE INVENTION

The present invention relates to accessories for power tools and fixtures for the purposes of positioning and repositioning a workpiece in woodworking and metalworking power tool applications—specifically concerning equipment and assemblies commonly referred to as "position locators" associated with table saws. More specifically, the preferred embodiment of the present invention relates to accessories acting upon the work fence of a table saw.

BACKGROUND OF THE INVENTION

Prior Art Published by the Inventor

Custom Fabricating Solutions. "Micro-Adjuster for Table Saw Fence 1." Online video clip. *Youtube*. Youtube, 12 Feb. 2014. Web. 25 Apr. 2014.

"Micro-Adjustable Table Saw Fence." *Custom Fabricating Solutions*. Weebly, n.d. Web. 25 Apr. 2014.

The Technical Problem of the Industry—Brief

The woodworking and metalworking industries utilize table saws—circular saws mounted underneath a work surface in a way that allows the saw blade to pass up through a slot in the work surface. Though it is capable of much more, the table saw is most often used to make wide pieces of wood or metal narrower through ripping and to make long pieces of wood or metal shorter through cross-cutting. Wood and metalworkers often make use of a fence in order to align and position said work-piece against said fence in relation to the cutting blade. A table saw can accommodate many different cutting actions through the use of various accessories and techniques, yet some operators are unable or unwilling to fully utilize their table saws; likewise, some operators are not able to properly operate their table saws, resulting in the loss of efficiency and capital. Even amongst the experienced, most can set up a fence quickly or precisely: there is a need for an accessory that allows for the fulfillment of both parameters, with reproducibility.

The Technical Problem—Detailed

The T-style table saw fence (such as that of U.S. Pat. No. 4,206,910 A, commonly and colloquially referred to as a Biesemeyer-style fence) has become one of—if not the—most widely used table saw fence styles in the industry because of its shallow learning curve, quick operation, and ease of use; there are some enduring problems with T-style fences that, if addressed, would have a wide-reaching positive effect on the industry at large. In fact, some products have been introduced that try to improve on the T-style fence and its operation, but there are no products available that improve the fence that they accessorize to the same degree of the present invention without detracting from the usefulness of the fence.

For imprecise ripping and cross-cutting the T-style table saw fence is arguably the best fence available, but this fence style is inherently less precise than indexing actions possible on other tools; the current methods of bumping, tapping, nudging, or otherwise hitting the T-style fence in order to reposition it in relation to the saw blade have been deemed "good enough for table saw work." In some cases, especially those in light metalwork, material joining, and other specialty woodwork, the operator must be more precise than "good enough" in order to produce a quality commodity. Instead of using their table saws to accomplish the higher-order cutting actions—e.g. cutting dadoes, creating tenons, plunge cutting—many operators elect to purchase other tools and equipment in order to overcome the apparent imprecision of the table saw. Operators would be able to increase material yield and cutting precision while continuing to benefit from the advantages of T-style fences if a new fence or fence accessory could allow for the precision of indexing T-style fences.

The Present Invention as a Solution to the Technical Problem

Carpenters and other metal and woodworkers must maximize their efficiency both with and of their equipment. One technique that table saw operators already utilize to maximize efficiency with a T-style fence is to affix a C-clamp or a spring/pinch clamp along the fence rail—that is, the rail [18] along which the fence travels perpendicular to the saw blade, rather than a "rail" of the surface of the fence [20] itself—in order to in order to establish a semi-permanent reference point. This reference point acts as a cutting coordinate locator, and can be used to help an operator mechanically recall a particular cutting coordinate. At its simplest, the preferred embodiment of the present invention can be thought of as an improvement upon the C-clamp or the spring clamp as a reference point for fences; at its most useful, however, the preferred embodiment can be used to improve upon the T-style fence design itself.

Table saws are thought to be relatively imprecise tools and are often relegated to inexact sizing operations because of the drawbacks in the otherwise extraordinary T-style fence. The preferred embodiment of the present invention allows operators to achieve a higher level of cutting precision by surmounting the shortcomings of the T-style fence: the preferred embodiment is a position locator which grants the ability to precisely adjust the fence through an indexing action—thereby averting or minimizing the drawbacks of the fence. Furthermore, a table saw equipped with the preferred embodiment of the present invention will be able to produce many of the higher-order cutting actions used by specialists—those cuts that require relatively precise adjustments, such as miters, dovetails, dadoes, tenons, rabbets, coves, and others—without needing to purchase additional expensive or complicated equipment.

SUMMARY OF THE INVENTION

Description of the Present Invention and its Use

Note: The inventor requests that the patent application be not limited to the dimensions or descriptions given hereafter; any specific dimensions of certain items are included in order to assist with the understanding of the present invention and the edification of the patent application. It is impractical to establish a single standard for all cutting stations, as requirements may vary widely from station to station (indeed, this fact is one of the reasons for the present invention's design in the first place). It is for these reasons that while some specific attributes are given in the following descriptions and parts list, some items are not specifically sized.

The preferred embodiment of the present invention consists of a main body [1] primarily shaped like a "“Ç” " (more specifically, a "C" main body [1] complete with a cedilla-like handle [6] comprising something of a "French C" as used in the phrase Ç a va) that has two apertures [9,8] in the main body [1]. The first aperture [9] is drilled up through the bottom of the "C," in order to accommodate a vertical clamping screw [4]. The second aperture [8] accommodates a horizontal screw [3]. The horizontal screw [3] is equipped with an adjustment knob [2] to ease the indexing action as well as to give a reference gauge for precise adjustments. The clamping screw [4] is equipped with a T-handle [6] to ease the clamping action.

The preferred embodiment is, effectively, a fence-positioning clamp that is to be attached to a table saw rail [18] in order to act as a reference point for the table saw fence [20] and by proxy the cutting coordinate of the table saw. The preferred embodiment is installed by placing the upper C-frame [14] of the main body [1] against the top face of the fence rail [18] in a way that the fence rail [18] takes up the space afforded by the fence rail gap [17] in the main body [1]. Once in place, the clamping action is accomplished much like a traditional C-clamp in that by rotating the handle in the clockwise or counter-clockwise direction the clamp will be tightened onto or loosed from the fence rail [18]. After an operator clamps the preferred embodiment securely and squarely onto the rail [18], the operator can twist the indexing screw [3] in order to rotate it deeper into and out of the aperture in the main body [1]. This rotation of the indexing screw minutely alters the cutting coordinate toward or away from the saw blade [22], and therefore alters the end result of the cutting action. Between these two actions—clamping and indexing—the preferred embodiment acts as both an imprecise work clamp and as a precise work indexer.

Example of Use with the Preferred Embodiment

A carpenter is tasked with replacing multiple cracked shelves in a bookcase, with the stipulation that the replacement shelves must fit into existing dadoes in the bookcase. The carpenter determines the desired dimensions of the finished product, and equips his or her table saw with a T-style fence and multiple iterations of the preferred embodiment. With the aid of a tape measure, the carpenter moves the T-style fence to a position that will cut his or her material at a size that is a quarter-inch larger than the desired shelf and tenon length. After locking the fence, the carpenter installs one iteration of the preferred embodiment in right-of-fence orientation just to the right of the table saw fence lock. The carpenter turns the adjustment knob until the indexing screw makes contact with the fence lock. After powering the saw and with the assistance of a push-stick, the carpenter feeds the work-piece through the cutting plane. The carpenter measures the cut material, and finds that the material is indeed one-quarter inch too large. The carpenter unlocks the fence lock and turns the adjustment knob four full revolutions in order to reduce the material size by one-quarter inch. Being careful to keep the fence lock against the indexing screw, the carpenter re-locks the fence. The carpenter sends the previously cut piece back through the cut plane of the rotating saw and finds that the material is properly sized. The carpenter unlocks and moves the T-style fence, but leaves the already-used iteration of the preferred embodiment on the fence rail, as it presents no obstruction to any subsequent actions.

The carpenter determines the depth necessary for the shelves, and moves the fence to a position that seems to be one-quarter inch larger than the desired cutting coordinate. As before, the carpenter installs and indexes a right-of-fence iteration of the preferred embodiment against the fence lock. After sending the material through a single pass, the carpenter checks the actual depth of the newly-cut shelf. Expecting to see ¼" of excess, the carpenter is surprised to see that the actual size of the shelf is only 1/16" over the desired depth. After unlocking the fence lock and indexing the adjustment knob one revolution inward, the carpenter re-locks the fence and re-cuts that same shelf piece at the new coordinate. After measuring and finding that the piece is now correctly sized, the carpenter sends the rest of the material through again and again until the material is exhausted.

Since these shelves must be shaped in order to fit into the bookshelf dadoes, the carpenter must cut away material until tenons (or tongues, as in tongue-in-groove construction) remain. The carpenter, knowing the width of the table saw blade, moves the fence close enough to the cutting plane of the saw blade so that if the shelf were to be pushed along the fence it would touch but the blade would not shape the fence in any major way. The carpenter installs a left-of-fence iteration of the preferred embodiment, and touches the indexing screw to the locked fence. Instead of screwing inwards, the carpenter turns the knob in the counter-clockwise direction in order to have the screw recede from the fence lock; the carpenter so turns the knob for one revolution. The carpenter unlocks the fence and moves it until it contacts the indexing screw of the present invention. The carpenter pushes the shelf through, so that a rabbet is formed. After verifying that this is the desired cut, the carpenter rotates the shelf so that the newly-cut face of the work-piece is against the fence and sends it through again. This action, taking two 1/16" cuts from the height of the shelf, is done a total of two times per shelf—once per side. These four cuts make a shelf with two grooves or tenons—one on each end—that are ⅛" smaller than the dimension of the shelf. The carpenter checks to see that the now finished shelf is the proper size by fitting it inside the bookcase. As long as the preferred embodiments are not moved, the carpenter can reuse these cutting coordinates (should the need for more identical shelves arise) by abutting the same fence and fence lock against the indexing screw of the preferred embodiments. However, if one of the preferred embodiments is altered or if a different fence is used, the carpenter will have to begin the sizing and indexing actions anew.

LIST OF THE COMPONENTS OF THE PRESENT INVENTION

Machined Pieces

| | | | |
|---|---|---|---|
| 1 | Main Body | 2 | Adjustment Knob |
| 3 | Indexing Screw | 4 | Clamp Screw |
| 5 | Contact/Pressure Plate | 6 | T-Handle |
| 7 | Retention Shoulder Bolt | | |

Apertures

| | | | |
|---|---|---|---|
| 8 | Tapped Horizontal Hole for Indexing Screw | 9 | Tapped Vertical Hole for Clamp Screw |
| 10 | Counter-Bored Through Hole | 11 | Blind Tapped Hole in Clamp Screw |
| 12 | Blind Tapped Hole in T-Handle | 13 | Blind Tapped Hole in Adjustment Knob |

Areas in the Scope of the Main Body

| | | | |
|---|---|---|---|
| 14 | Upper C-Frame Extension | 15 | Lower C-Frame Extension |
| 16 | Body Extension/Projection for Indexing | 17 | Fence Rail Gap |

Accompanying Pieces (Those not Expressly Included in the Present Invention)

| | | | |
|---|---|---|---|
| 18 | Fence Rail | 19 | Table Saw Surface |
| 20 | Table Saw Fence | 21 | Fence Lock |
| 22 | Saw Blade | 23 | Contact Point of Index Screw on Fence Lock |

DESCRIPTION OF THE PREFERRED EMBODIMENT

Figure 1:
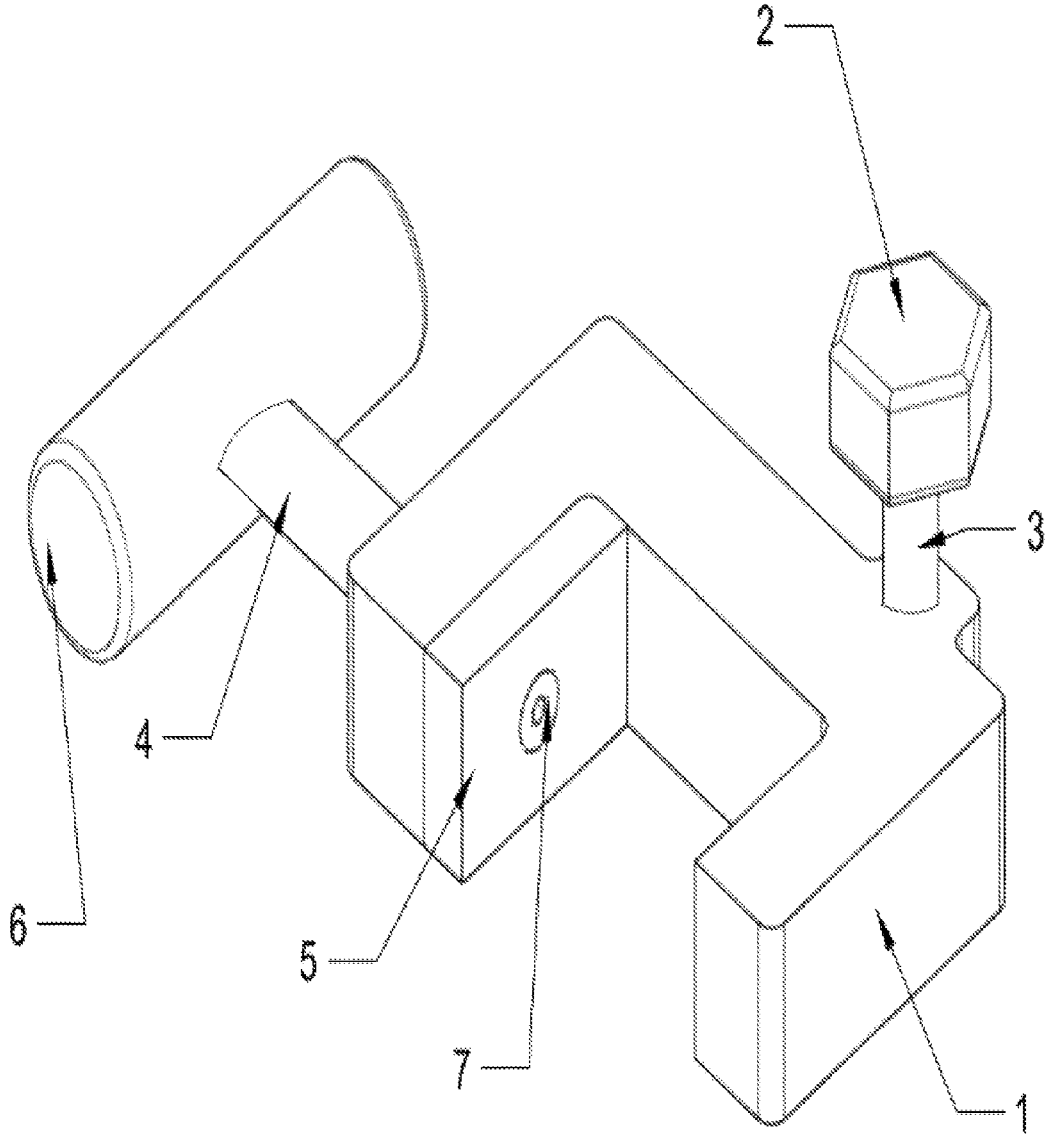
FIG. 1 is an isometric view of an assembly of the preferred embodiment; while the indexing screw [3] and the adjustment knob [2] can be installed in either side of the main body [1], the drawing shows the preferred embodiment in a right-of-fence orientation.
Figure 2:
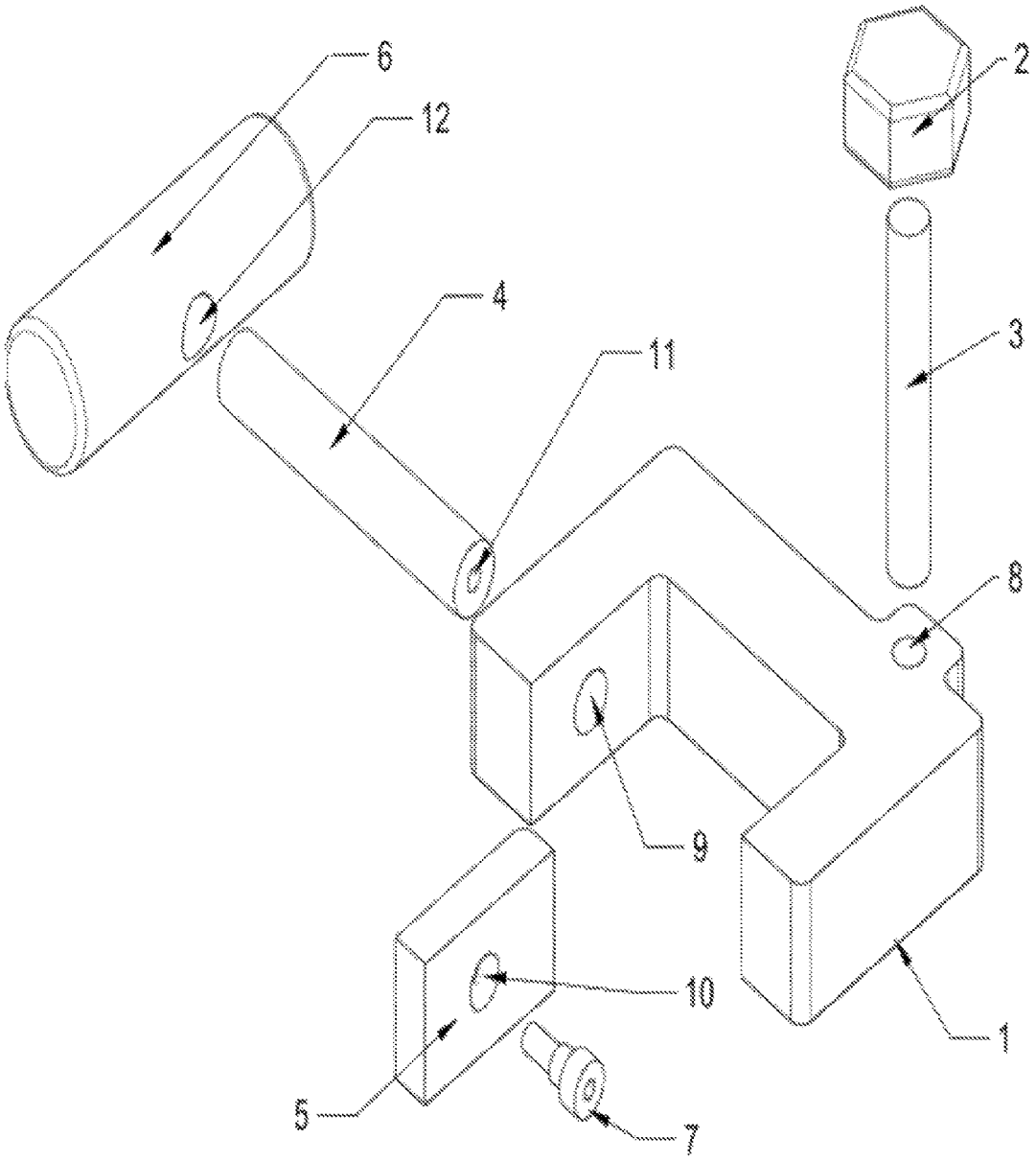
FIG. 2 is an isometric exploded view of the preferred embodiment in a right-of-fence orientation, showing the hardware and makeup of the assembly.
Figure 3:
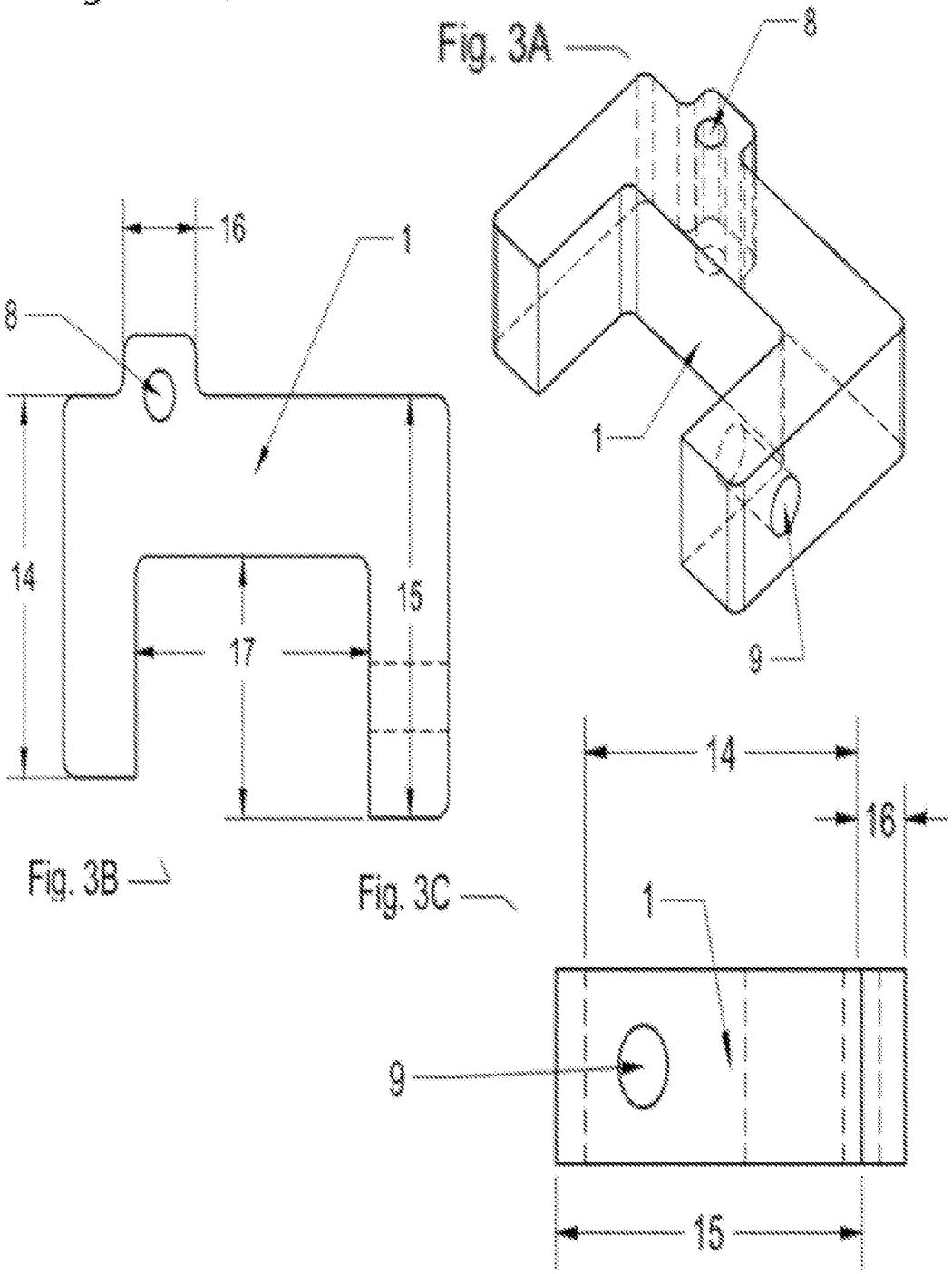
FIG. 3A is an isometric view of the main body [1] of the preferred embodiment, showing the apertures [8,9] of the main body as well as the main body [1] itself.
FIG. 3B is a side-view of a wire-frame model of the main body [1], showing the main body extensions [14,15,16] and the fence rail gap [17]. The upper C-frame [14] and lower C-frame [15], as well as the extension [16] for the indexing action, are simply sections of the main body [1] in the preferred embodiment. (In an alternative embodiment, one or all of these may be separate from the main body.)
FIG. 3C is a bottom-view of the main body [1], showing another angle of the body extensions [15,16]. The upper C-frame extension [14] is hidden in this view, but still present in the piece.
Figure 4:
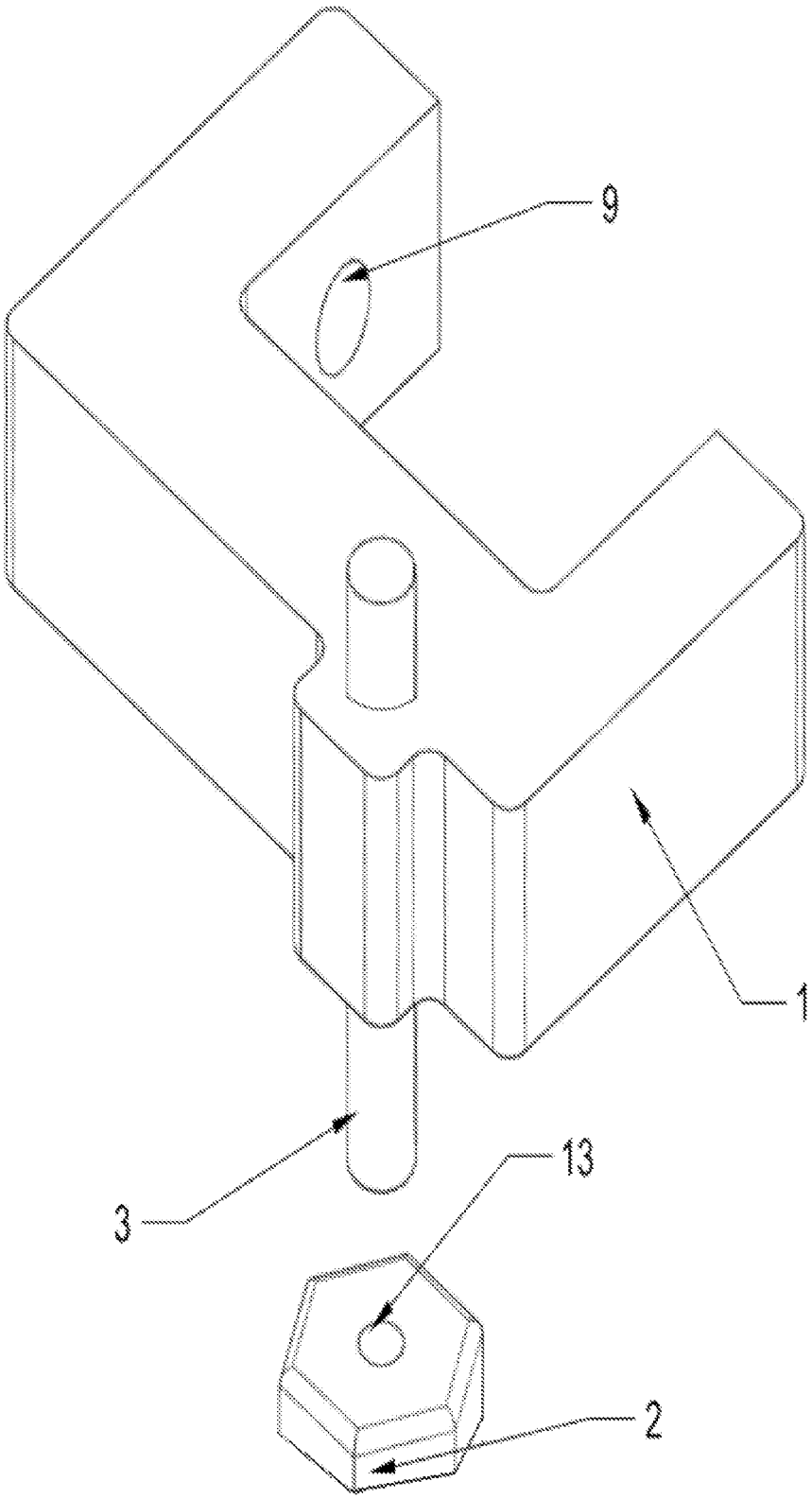
FIG. 4 is an inverted isometric view of the parts necessary for the indexing action, including the adjustment knob [2], the indexing screw [3], and the main body [1]. The adjuster knob [2] has been removed from the indexing screw [3] in order to display the drilled and tapped aperture [13] within the adjuster knob [2] that houses the indexing screw [3]. This view better shows the indexing screw [3] extending through the main body [1] as the means of accomplishing the indexing action.
Figure 5:
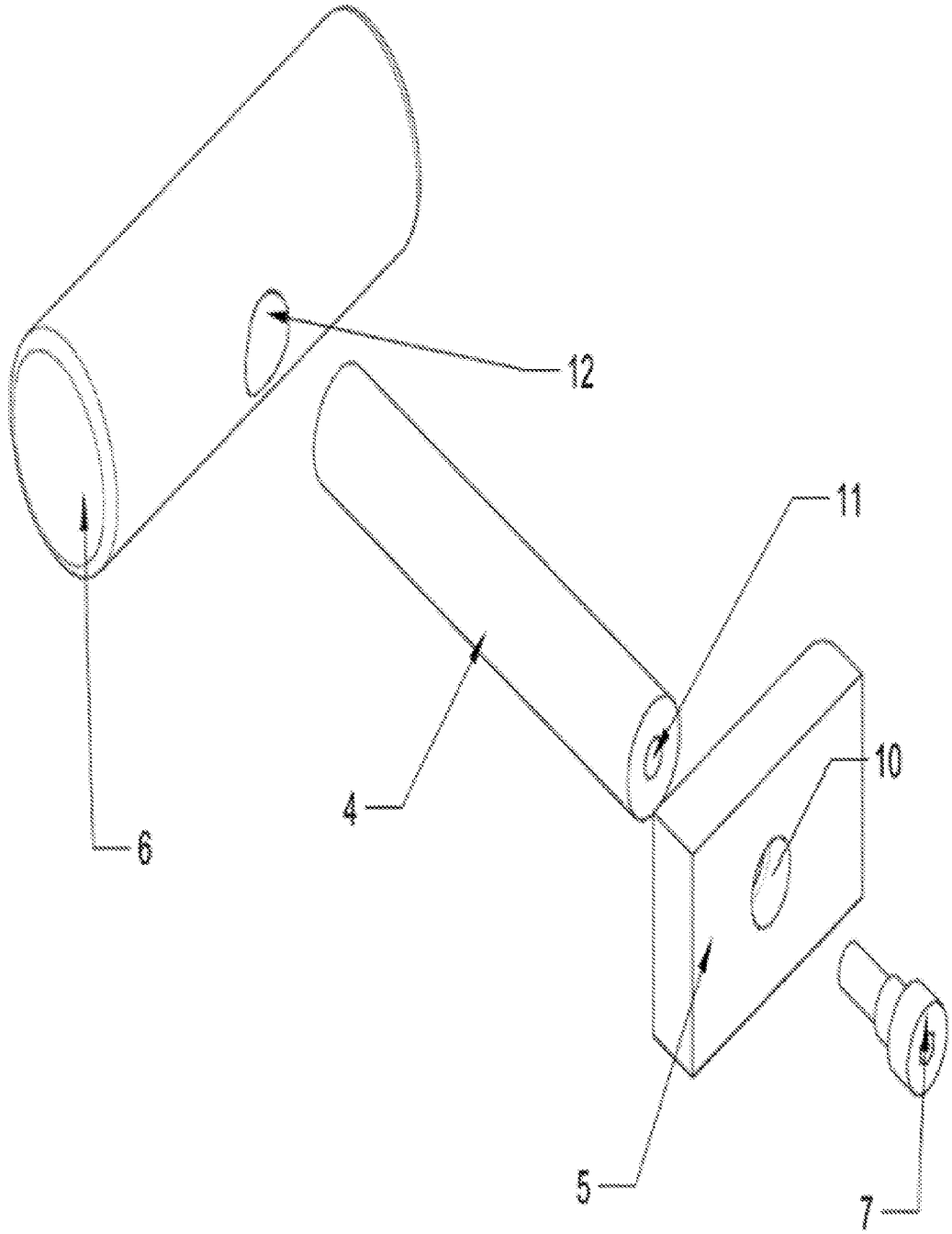
FIG. 5 is an isometric view of the parts necessary for the clamping action—without the main body [1]—to better show the assembly of the T-handle [6], the clamp screw [4], the contact plate [5], and the retention bolt [7]. The apertures of the preferred embodiment include a blind hole [12] drilled and tapped to accommodate the clamp screw [4], the counter bored through hole [10] of the contact plate [5], and the tapped blind hole [11] in the clamp screw [4] itself in order to accommodate a shoulder bolt [7].
Figure 6:
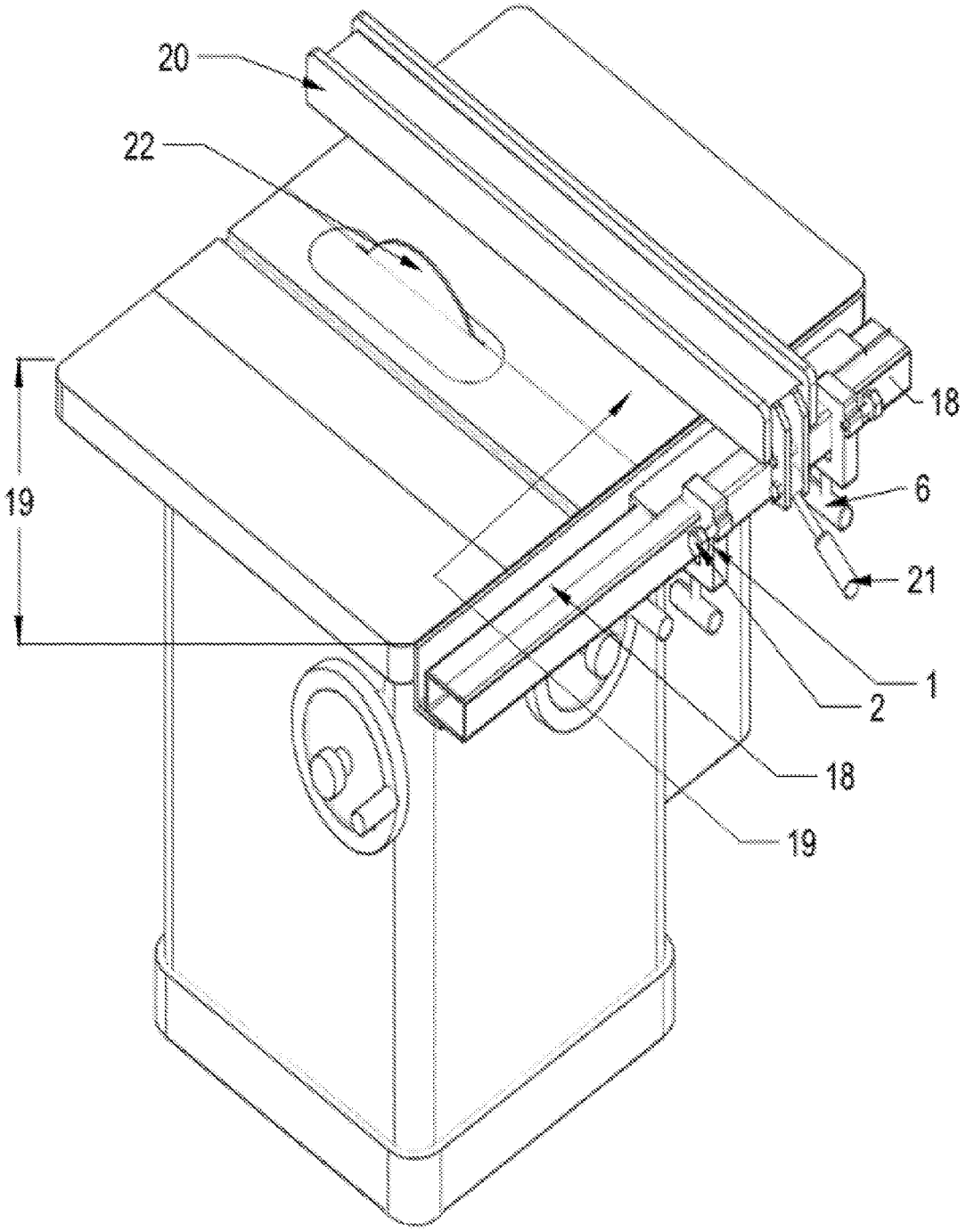
FIG. 6 is an isometric view of an entire table saw cutting and ripping station. It shows the implementation of a T-style fence on a table saw, and it also shows two examples of the preferred embodiment installed along the table saw's fence rail [18], one in the left-of-fence orientation and one in the right-of-fence orientation.
Figure 7:
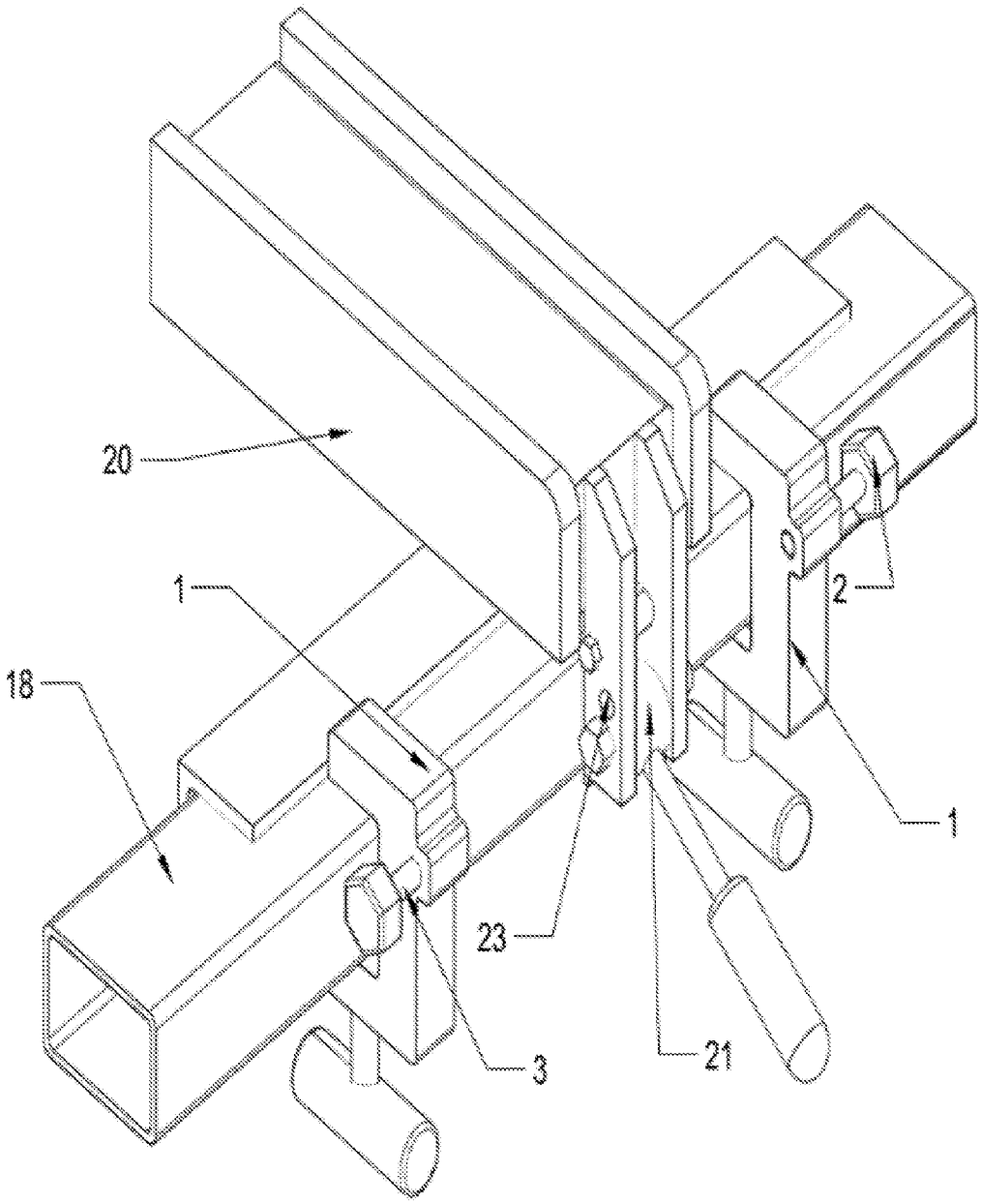
FIG. 7 is a view of the fence [20] and fence rail [18] with a closer view of the fence lock [21] mechanism. This closer view better shows the advantages of the shape of the main body [1]. One such advantage includes fitting beneath the fence [20] and moving the indexing action toward the operator. This view shows the contact point [23] of the indexing screw [3] upon the fence lock [21].

The embodiments of the present invention in which an exclusive property or privilege is claimed are defined as follows:

The preferred embodiment of the present invention consists of a single machined piece [1] that itself consists of various structures—an upper portion of the C-frame [14], a lower portion of the C-frame [15], and a protrusion [16] to accommodate the indexing screw [3]. The shape of the main body [1] of the preferred embodiment allows the preferred embodiment to be useful in the woodworking and metal-working industries, specifically as an accessory to T-style fences in use on table saws. The upper extension, or the upper C-frame [14], of the main body is so shaped as to fit beneath both the fence [18] and the plane [19] of the table saw surface. The indexing extension [16] allows the contact point [23] of the indexing screw [3] and the fence lock [21] to be moved—closer to the operator and farther from the fence lock [21] and other structures—which allows the adjustment knob [2] to be removed from potential obstruction. This removal from potential obstruction makes the rotation of said adjustment knob [2] more easily accomplished by the operator.

The preferred embodiment includes a tapped aperture [8] with a 0.3125" diameter and a ⅜-16 thread pattern that has been positioned within the bounds of a projection [16] of the main body [1] itself; this aperture houses a threaded rod [3] of the same thread pattern, and the interaction of these two pieces constitutes the indexing action. The preferred embodiment includes a hex-head adjustment knob [2] at the opposite end of the indexing rod [3] from the contact point [23] between the present invention and the table saw fence lock [21]. Those familiar with the industry will know that a ⅜-16 thread pattern refers to the fact that a bolt with that thread pattern, when in a nut or tapped hole with the same thread pattern, will travel one inch for every sixteen 360° revolutions; when an operator rotates the hex-head adjustment knob [2] a full 360° rotation, the indexing screw [3] of the preferred embodiment will travel 0.0625", or one-sixteenth of an inch. This adjustment knob [2], acting upon the ⅜-16 thread pattern of the indexing screw [3], acts as a tactile gauge affording an operator the opportunity to make precise adjustments: by reduction, turning the adjustment knob [2] one-sixth of a single revolution, or the equivalent of one face of the hex-head, results in indexed travel equal to one-sixth of one-sixteenth of an inch—0.01042", approximately ten thousandths of an inch.

The preferred embodiment includes a tapped aperture [9] in the main body [1] with a 0.4219" through hole tapped with a ½-13 thread pattern which accommodates a ½-13 vertical clamping screw [4]. The clamping screw [4] is rotated within the aforementioned aperture [9], moving in relation to the main body [1] and constituting the clamping action of the preferred embodiment. The T-handle [6] has a drilled and tapped aperture [12] with a ½-13 thread pattern which permanently houses the clamping screw [4]. The end of the clamping screw opposite the T-handle [6] has an aperture [11] that consists of a 0.1719" blind hole [11] drilled to 0.75" depth and tapped at 0.5" depth with a 10-24 thread pattern. This hole [11] in the clamping screw [4] accommodates a 10-24 threaded shoulder bolt [7]. A plate [5] with a 0.25" OD through hole [10] counter bored to 0.375" at 0.1875" depth is used as the contact point of the clamping action against the bottom of the fence rail [18] of the table saw. In the preferred embodiment of the present invention, the shoulder bolt [7] is inserted into the contact plate [5] through the counter-bored aperture [10] and the exposed thread of the bolt [7] is threaded into the tapped aperture [11] of the clamping screw [4]. Once the bolt [7] is tightened, the contact plate [5] is held against the main body [1] so that the plate [5] cannot rotate or become misaligned. In this way, the shoulder bolt [7] acts as a retention screw for the contact plate [5] and by extension the entire clamping action.

Advantageous Effects of the Present Invention

1. The preferred embodiment of the present invention consists of a single piece of machined billet aluminum, so as to remain rigid through all actions of its operation and to secure longevity.
2. The preferred embodiment of the present invention is engineered to fit onto table saw fence rails from 0.75" to 2" height while extending upward from the rail no higher than the material work-piece plane. Because of this, the preferred embodiment does not need to be removed from the table in order to clear the work-piece plane [19]: an operator can keep a cutting coordinate despite using the table for other actions.
   - 2.a. If an operator's fence rail is smaller or larger than what the preferred embodiment can easily accommodate, an alternative embodiment of the present invention involves machining the main body [1] to make the fence rail gap [17] larger, or to use a longer clamping screw [4] and thicker contact plate [5] to make the fence rail gap [17] smaller.
   - 2.b. If an operator's fence rail is a different shape or profile from traditional T-style fences, an alternative embodiment of the present invention involves machining the main body [1] and contact plate [5] in order to accommodate their respective contact surfaces. If the fence rail [18] is curved, knurled, or otherwise atypical, the corresponding contact surfaces can be made likewise.
3. The preferred embodiment will stay affixed to the strut rail [18] independent of the fence [20] and fence lock [21]. Knowing this, an operator can unlock and remove a T-style fence from the table saw—a desirable feature—without dislodging the preferred embodiment from its referencing coordinate. In this way, the preferred embodiment neither subtracts a feature from the T-style fence system, nor fails in its own action as a work position locator.
4. The preferred embodiment of the indexing action allows operators to bring material in to size, precisely. If material is expensive, it may not be economical to risk undercutting a piece. If a precise go/no-go gauge is used, attempting to bump the fence into a new coordinate may risk over-correction or under-correction, resulting in the loss of material or time. By cutting slightly larger than is called for and then dialing the fence in with the preferred embodiment, the risk of significant lost time and capital is replaced with a negligible loss of time and capital.
   - 4.a. The preferred embodiment uses an adjustment schedule based off of the rotation of the adjustment knob [2] to offer operators a visual and haptic response to a change in the cutting coordinate. With this schedule (please see "Adjustment Schedules . . . " below) an operator can alter the size of a workpiece much more precisely than through a bump or tap: down to a registrable change of 5 thousandths. Operators must remain vigilant, however; a single assembly will drive the fence in one direction, but it will not pull the fence backward, nor will it lock the fence in place per se. A fence lock [21] should be used whenever using a table saw.
5. The preferred embodiment of the indexing and clamping actions allows operators to fully utilize the table saw for various cutting actions that require precision. Please see "Examples of Use with the Preferred Embodiment" for further edification.

Adjustment Schedule of the Preferred Embodiment (⅜-16 Hex-Head Adjustment Bolt or Screw)

| Revolutions of the Adjuster | Coordinate Change (fractional representation) | Coordinate Change (decimal representation) |
|---|---|---|
| 2 revolutions (12 faces or flats) | ⅛ inch | .125" |
| 1 revolution (6 faces) | 1/16 inch | .0625" |
| ½ revolution (3 faces) | 1/32 inch | .03125" |
| ⅙ revolution (1 face) | 1/96 inch | .01042" |
| 1/12 revolution (1/2 face) | 1/192 inch | .0052" |

What I, the inventor, claim is:

1. A woodworking and metalworking accessory for use as a clamp comprising:

a main body from which two or more protrusions extend to form one or more concave structures;

a threaded rod indexed at a right angle to the two or more protrusions and adapted to clamp the wood working and metal working accessory to a work surface;

a separate threaded rod indexed orthogonally to said main body and said two or more protrusions, wherein said separate threaded rod is indexed through a tapped aperture formed in the main body and is adapted to exert force on a fence rail, work piece or other movable object positioned on the work surface;

wherein the threaded rod is indexed along an x-axis, the separate threaded rod is indexed along a y-axis perpendicular to the x-axis and the two or more protrusions extend along a z-axis, perpendicular to both the x-axis and the y-axis.

2. The accessory of claim 1, wherein the main body is adapted for installation on a work surface selected from the group comprising a table saw, a router table, a mill table or another benchtop and is adapted to allow for uninhibited use of a work table surface when said accessory is installed thereon.

3. The accessory of claim 1, wherein one of said two or more protrusions is a lower extension of the main body and another of said two or more protrusions is an upper extension of the main body and the lower extension of the main body has a tapped aperture formed therein for receiving the threaded rod, such that when the threaded rod is rotated through the tapped aperture the threaded rod moves toward or away from the upper extension of the main body.

4. The accessory of claim 1, wherein the separate threaded rod is indexed to move the fence rail, work piece or other movable object in precise increments to enable repeatable machining.

5. The accessory of claim 1, wherein the threaded rod includes a contact surface mounted thereon which is adapted to move toward one of said two or more protrusions to provide a clamping surface area.

* * * * *